US010094380B2

(12) United States Patent
Doepker et al.

(10) Patent No.: US 10,094,380 B2
(45) **Date of Patent: *Oct. 9, 2018**

(54) COMPRESSOR

(71) Applicant: Emerson Climate Technologies, Inc., Sidney, OH (US)

(72) Inventors: Roy J. Doepker, Lima, OH (US); Michael M. Perevozchikov, Tipp City, OH (US)

(73) Assignee: Emerson Climate Technologies, Inc., Sidney, OH (US)

( * ) Notice: Subject to any disclaimer, the term of this patent is extended or adjusted under 35 U.S.C. 154(b) by 84 days.

This patent is subject to a terminal disclaimer.

(21) Appl. No.: 14/757,407

(22) Filed: Dec. 23, 2015

(65) Prior Publication Data

US 2016/0115954 A1 Apr. 28, 2016

Related U.S. Application Data

(63) Continuation of application No. 14/060,240, filed on Oct. 22, 2013, now Pat. No. 9,249,802.

(Continued)

(51) Int. Cl.
*F01C 21/18* (2006.01)
*F04C 2/08* (2006.01)

(Continued)

(52) U.S. Cl.
CPC ..... *F04C 18/0223* (2013.01); *F04C 18/0215* (2013.01); *F04C 18/0246* (2013.01); *F04C 18/0261* (2013.01); *F04C 29/126* (2013.01)

(58) Field of Classification Search
CPC ..... F04C 18/0223; F04C 18/0215; F04C 18/0261; F04C 29/126

(Continued)

(56) References Cited

U.S. PATENT DOCUMENTS 4,058,988 A 11/1977 Shaw
4,216,661 A 8/1980 Tojo et al.

(Continued)

FOREIGN PATENT DOCUMENTS

CN 1137614 A 12/1996
CN 1158944 A 9/1997

(Continued)

OTHER PUBLICATIONS

Interview Summary regarding U.S. Appl. No. 14/060,240, dated Dec. 1, 2015.

(Continued)

*Primary Examiner* — Deming Wan
(74) *Attorney, Agent, or Firm* — Harness, Dickey & Pierce, P.L.C.

(57) ABSTRACT

A compressor may include first and second scrolls, a hub plate and a valve. The first scroll may include an end plate defining first and second sides, a primary discharge passage extending therethrough, and a secondary discharge passage extending therethrough and located radially outward from the primary discharge passage. The hub plate may be mounted to the first scroll and may include first and second opposite sides and a hub discharge passage in fluid communication with the primary discharge passage. The first side of the hub plate may face the second side of the end plate and may include a valve guide extending axially toward the end plate adjacent the hub discharge passage. The valve member may be secured on the valve guide for axial movement between open and closed positions to respectively allow and restrict fluid communication between the secondary discharge passage and the hub discharge passage.

18 Claims, 5 Drawing Sheets

Related U.S. Application Data

(60) Provisional application No. 61/726,684, filed on Nov. 15, 2012.

(51) Int. Cl.
*F04C 29/12* (2006.01)
*F04C 18/02* (2006.01)

(58) Field of Classification Search
USPC ..... 418/55.1, 55.4–55.6, 180
See application file for complete search history.

(56) References Cited

U.S. PATENT DOCUMENTS 4,382,370 A 5/1983 Suefuji et al.
4,383,805 A 5/1983 Teegarden et al.
4,389,171 A 6/1983 Eber et al.
4,475,360 A 10/1984 Suefuji et al.
4,497,615 A 2/1985 Griffith
4,545,742 A 10/1985 Schaefer
4,580,949 A 4/1986 Maruyama et al.
4,609,329 A 9/1986 Pillis et al.
4,696,630 A 9/1987 Sakata et al.
4,727,725 A 3/1988 Nagata et al.
4,774,816 A 10/1988 Uchikawa et al.
4,818,195 A 4/1989 Murayama et al.
4,846,633 A 7/1989 Suzuki et al.
4,877,382 A 10/1989 Caillat et al.
4,886,425 A 12/1989 Itahana et al.
4,940,395 A 7/1990 Yamamoto et al.
5,040,952 A 8/1991 Inoue et al.
5,055,010 A 10/1991 Logan
5,059,098 A 10/1991 Suzuki et al.
5,071,323 A 12/1991 Sakashita et al.
5,074,760 A 12/1991 Hirooka et al.
5,080,056 A 1/1992 Kramer et al.
5,085,565 A 2/1992 Barito
RE34,148 E 12/1992 Terauchi et al.
5,169,294 A 12/1992 Barito
5,192,195 A 3/1993 Iio et al.
5,193,987 A 3/1993 Iio et al.
5,240,389 A 8/1993 Oikawa et al.
5,253,489 A 10/1993 Yoshii
5,356,271 A 10/1994 Miura et al.
5,451,146 A 9/1995 Inagaki et al.
5,482,637 A 1/1996 Rao et al.
5,551,846 A 9/1996 Taylor et al.
5,557,897 A 9/1996 Kranz et al.
5,562,426 A 10/1996 Watanabe et al.
5,577,897 A 11/1996 Inagaki et al.
5,607,288 A 3/1997 Wallis et al.
5,611,674 A 3/1997 Bass et al.
5,613,841 A 3/1997 Bass et al.
5,639,225 A 6/1997 Matsuda et al.
5,640,854 A 6/1997 Fogt et al.
5,674,058 A 10/1997 Matsuda et al.
5,678,985 A 10/1997 Brooke et al.
5,707,210 A 1/1998 Ramsey et al.
5,722,257 A 3/1998 Ishii et al.
5,741,120 A 4/1998 Bass et al.
5,855,475 A 1/1999 Fujio et al.
5,885,063 A 3/1999 Makino et al.
5,993,171 A 11/1999 Higashiyama
5,993,177 A 11/1999 Terauchi et al.
6,047,557 A 4/2000 Pham et al.
6,086,335 A 7/2000 Bass et al.
6,095,765 A 8/2000 Khalifa
6,102,671 A 8/2000 Yamamoto et al.
6,123,517 A 9/2000 Brooke et al.
6,123,528 A 9/2000 Sun et al.
6,132,179 A 10/2000 Higashiyama
6,139,287 A 10/2000 Kuroiwa et al.
6,139,291 A 10/2000 Perevozchikov
6,149,401 A 11/2000 Iwanami et al.
6,164,940 A 12/2000 Terauchi et al.
6,176,686 B1 1/2001 Wallis et al.
6,179,589 B1 1/2001 Bass et al.
6,202,438 B1 3/2001 Barito
6,210,120 B1 4/2001 Hugenroth et al.
6,213,731 B1 4/2001 Doepker et al.
6,231,316 B1 5/2001 Wakisaka et al.
6,273,691 B1 8/2001 Morimoto et al.
6,293,767 B1 9/2001 Bass
6,293,776 B1 9/2001 Hahn et al.
6,322,340 B1 11/2001 Itoh et al.
6,350,111 B1 2/2002 Perevozchikov et al.
6,379,123 B1 4/2002 Makino et al.
6,412,293 B1 7/2002 Pham et al.
6,413,058 B1 7/2002 Williams et al.
6,419,457 B1 7/2002 Seibel et al.
6,428,286 B1 8/2002 Shimizu et al.
6,454,551 B2 9/2002 Kuroki et al.
6,457,948 B1 10/2002 Pham
6,464,481 B2 10/2002 Tsubai et al.
6,478,550 B2 11/2002 Matsuba et al.
6,506,036 B2 1/2003 Tsubai et al.
6,537,043 B1 3/2003 Chen
6,544,016 B2 4/2003 Gennami et al.
6,558,143 B2 5/2003 Nakajima et al.
6,589,035 B1 7/2003 Tsubono et al.
6,679,683 B2 1/2004 Seibel et al.
6,715,999 B2 4/2004 Ancel et al.
6,769,881 B2 8/2004 Lee
6,769,888 B2 8/2004 Tsubono et al.
6,773,242 B1 8/2004 Perevozchikov
6,817,847 B2 11/2004 Agner
6,821,092 B1 11/2004 Gehret et al.
6,863,510 B2 3/2005 Cho
6,881,046 B2 4/2005 Shibamoto et al.
6,884,042 B2 4/2005 Zili et al.
6,893,229 B2 5/2005 Choi et al.
6,896,498 B1 5/2005 Patel
6,913,448 B2 7/2005 Liang et al.
6,984,114 B2 1/2006 Zili et al.
7,018,180 B2 3/2006 Koo
7,029,251 B2 4/2006 Chang et al.
7,118,358 B2 10/2006 Tsubono et al.
7,137,796 B2 11/2006 Tsubono et al.
7,160,088 B2 1/2007 Peyton
7,207,787 B2 4/2007 Liang et al.
7,229,261 B2 6/2007 Morimoto et al.
7,255,542 B2 8/2007 Lifson et al.
7,261,527 B2 8/2007 Alexander et al.
7,311,740 B2 12/2007 Williams et al.
7,344,365 B2 3/2008 Takeuchi et al.
RE40,257 E 4/2008 Doepker et al.
7,354,259 B2 4/2008 Tsubono et al.
7,364,416 B2 4/2008 Liang et al.
7,371,057 B2 5/2008 Shin et al.
RE40,399 E 6/2008 Hugenroth et al.
RE40,400 E 6/2008 Bass et al.
7,393,190 B2 7/2008 Lee et al.
7,404,706 B2 7/2008 Ishikawa et al.
RE40,554 E 10/2008 Bass et al.
7,510,382 B2 3/2009 Jeong
7,547,202 B2 6/2009 Knapke
7,695,257 B2 4/2010 Joo et al.
7,717,687 B2 5/2010 Reinhart
7,771,178 B2 8/2010 Perevozchikov et al.
7,802,972 B2 9/2010 Shimizu et al.
7,815,423 B2 10/2010 Guo et al.
7,891,961 B2 2/2011 Shimizu et al.
RE42,371 E 5/2011 Peyton
7,967,582 B2 6/2011 Akei et al.
7,967,583 B2 6/2011 Stover et al.
7,972,125 B2 7/2011 Stover et al.
7,976,289 B2 7/2011 Masao
7,976,295 B2 7/2011 Stover et al.
7,988,433 B2 8/2011 Akei et al.
8,025,492 B2 9/2011 Seibel et al.
8,303,278 B2 11/2012 Roof et al.
8,303,279 B2 11/2012 Hahn
8,308,448 B2 11/2012 Fields et al.
8,328,531 B2 12/2012 Milliff et al.

(56) References Cited

U.S. PATENT DOCUMENTS

| | | | |
|---|---|---|---|
| 8,506,271 | B2 | 8/2013 | Seibel et al. |
| 8,517,703 | B2 | 8/2013 | Doepker |
| 8,585,382 | B2 | 11/2013 | Akei et al. |
| 8,616,014 | B2 | 12/2013 | Stover et al. |
| 8,790,098 | B2 | 7/2014 | Stover et al. |
| 8,840,384 | B2 | 9/2014 | Patel et al. |
| 8,857,200 | B2 | 10/2014 | Stover et al. |
| 8,932,036 | B2 | 1/2015 | Monnier et al. |
| 9,127,677 | B2 | 9/2015 | Doepker |
| 9,145,891 | B2 | 9/2015 | Kim et al. |
| 9,249,802 | B2 * | 2/2016 | Doepker ..... F04C 29/126 |
| 9,303,642 | B2 | 4/2016 | Akei et al. |
| 9,435,340 | B2 | 9/2016 | Doepker et al. |
| 9,494,157 | B2 | 11/2016 | Doepker |
| 9,605,677 | B2 | 3/2017 | Heidecker et al. |
| 9,651,043 | B2 | 5/2017 | Stover et al. |
| 9,777,730 | B2 | 10/2017 | Doepker et al. |
| 9,790,940 | B2 | 10/2017 | Doepker et al. |
| 9,879,674 | B2 | 1/2018 | Akei et al. |
| 2001/0010800 | A1 | 8/2001 | Kohsokabe et al. |
| 2002/0039540 | A1 | 4/2002 | Kuroki et al. |
| 2003/0044296 | A1 | 3/2003 | Chen |
| 2003/0186060 | A1 | 10/2003 | Rao |
| 2003/0228235 | A1 | 12/2003 | Sowa et al. |
| 2004/0136854 | A1 | 7/2004 | Kimura et al. |
| 2004/0146419 | A1 | 7/2004 | Kawaguchi et al. |
| 2004/0184932 | A1 | 9/2004 | Lifson |
| 2004/0197204 | A1 | 10/2004 | Yamanouchi et al. |
| 2005/0019177 | A1 | 1/2005 | Shin et al. |
| 2005/0019178 | A1 | 1/2005 | Shin et al. |
| 2005/0053507 | A1 | 3/2005 | Takeuchi et al. |
| 2005/0069444 | A1 | 3/2005 | Peyton |
| 2005/0201883 | A1 | 9/2005 | Clendenin et al. |
| 2005/0214148 | A1 | 9/2005 | Ogawa et al. |
| 2006/0099098 | A1 | 5/2006 | Lee et al. |
| 2006/0198748 | A1 | 9/2006 | Grassbaugh et al. |
| 2006/0228243 | A1 | 10/2006 | Sun et al. |
| 2006/0233657 | A1 | 10/2006 | Bonear et al. |
| 2007/0036661 | A1 | 2/2007 | Stover |
| 2007/0110604 | A1 | 5/2007 | Peyton |
| 2007/0130973 | A1 | 6/2007 | Lifson et al. |
| 2008/0138227 | A1 | 6/2008 | Knapke |
| 2008/0159892 | A1 | 7/2008 | Huang et al. |
| 2008/0159893 | A1 | 7/2008 | Caillat |
| 2008/0196445 | A1 | 8/2008 | Lifson et al. |
| 2008/0223057 | A1 | 9/2008 | Lifson et al. |
| 2008/0305270 | A1 | 12/2008 | Uhlianuk et al. |
| 2009/0035167 | A1 | 2/2009 | Sun |
| 2009/0068048 | A1 | 3/2009 | Stover et al. |
| 2009/0071183 | A1 | 3/2009 | Stover et al. |
| 2009/0185935 | A1 | 7/2009 | Seibel et al. |
| 2009/0297377 | A1 | 12/2009 | Stover et al. |
| 2009/0297378 | A1 | 12/2009 | Stover et al. |
| 2009/0297379 | A1 | 12/2009 | Stover et al. |
| 2009/0297380 | A1 | 12/2009 | Stover et al. |
| 2010/0111741 | A1 | 5/2010 | Chikano et al. |
| 2010/0135836 | A1 | 6/2010 | Stover et al. |
| 2010/0158731 | A1 | 6/2010 | Akei et al. |
| 2010/0212311 | A1 | 8/2010 | McQuary et al. |
| 2010/0254841 | A1 | 10/2010 | Akei et al. |
| 2010/0300659 | A1 | 12/2010 | Stover et al. |
| 2010/0303659 | A1 | 12/2010 | Stover et al. |
| 2011/0135509 | A1 | 6/2011 | Fields et al. |
| 2011/0206548 | A1 | 8/2011 | Doepker |
| 2011/0293456 | A1 | 12/2011 | Seibel et al. |
| 2012/0107163 | A1 | 5/2012 | Monnier et al. |
| 2013/0078128 | A1 | 3/2013 | Akei |
| 2013/0121857 | A1 | 5/2013 | Liang et al. |
| 2013/0309118 | A1 | 11/2013 | Ginies et al. |
| 2013/0315768 | A1 | 11/2013 | Le Coat et al. |
| 2014/0023540 | A1 | 1/2014 | Heidecker et al. |
| 2014/0024563 | A1 | 1/2014 | Heidecker et al. |
| 2014/0037486 | A1 | 2/2014 | Stover et al. |
| 2014/0134030 | A1 | 5/2014 | Stover et al. |
| 2014/0147294 | A1 | 5/2014 | Fargo et al. |
| 2014/0154121 | A1 | 6/2014 | Doepker |
| 2014/0154124 | A1 | 6/2014 | Doepker et al. |
| 2015/0192121 | A1 | 7/2015 | Sung et al. |
| 2015/0330386 | A1 | 11/2015 | Doepker |
| 2015/0345493 | A1 | 12/2015 | Lochner et al. |
| 2015/0354719 | A1 | 12/2015 | van Beek et al. |
| 2017/0002817 | A1 | 1/2017 | Stover |
| 2017/0002818 | A1 | 1/2017 | Stover |
| 2017/0030354 | A1 | 2/2017 | Stover |
| 2017/0268510 | A1 | 9/2017 | Stover et al. |
| 2017/0306960 | A1 | 10/2017 | Pax et al. |
| 2017/0314558 | A1 | 11/2017 | Pax et al. |
| 2018/0038369 | A1 | 2/2018 | Doepker et al. |
| 2018/0038370 | A1 | 2/2018 | Doepker et al. |

FOREIGN PATENT DOCUMENTS

| | | | |
|---|---|---|---|
| CN | 1158945 | A | 9/1997 |
| CN | 1289011 | A | 3/2001 |
| CN | 1349053 | A | 5/2002 |
| CN | 1517553 | A | 8/2004 |
| CN | 1680720 | A | 10/2005 |
| CN | 1702328 | A | 11/2005 |
| CN | 2747381 | Y | 12/2005 |
| CN | 1828022 | A | 9/2006 |
| CN | 1963214 | A | 5/2007 |
| CN | 1995756 | A | 7/2007 |
| CN | 101358592 | A | 2/2009 |
| CN | 101761479 | A | 6/2010 |
| CN | 101806302 | A | 8/2010 |
| CN | 101910637 | A | 12/2010 |
| CN | 102076963 | A | 5/2011 |
| CN | 102089525 | A | 6/2011 |
| CN | 102272454 | A | 12/2011 |
| CN | 102422024 | A | 4/2012 |
| CN | 102449314 | A | 5/2012 |
| CN | 102762866 | A | 10/2012 |
| CN | 202926640 | U | 5/2013 |
| CN | 103502644 | A | 1/2014 |
| CN | 204041454 | U | 12/2014 |
| CN | 104838143 | A | 8/2015 |
| CN | 205533207 | U | 8/2016 |
| CN | 205876712 | U | 1/2017 |
| CN | 205876713 | U | 1/2017 |
| CN | 205895597 | U | 1/2017 |
| EP | 0822335 | A2 | 2/1998 |
| EP | 1067289 | A2 | 1/2001 |
| EP | 1087142 | A2 | 3/2001 |
| EP | 1182353 | A1 | 2/2002 |
| EP | 1241417 | A1 | 9/2002 |
| EP | 1371851 | A2 | 12/2003 |
| EP | 1382854 | A2 | 1/2004 |
| EP | 2151577 | A1 | 2/2010 |
| GB | 2107829 | A | 5/1983 |
| JP | 60259794 | | 12/1985 |
| JP | S6385277 | A | 4/1988 |
| JP | 63-205482 | | 8/1988 |
| JP | H0281982 | A | 3/1990 |
| JP | 03081588 | A | 4/1991 |
| JP | H04272490 | A | 9/1992 |
| JP | H07-293456 | A | 11/1995 |
| JP | H08247053 | A | 9/1996 |
| JP | 08334094 | A | 12/1996 |
| JP | H8320079 | A | 12/1996 |
| JP | H09-177689 | A | 7/1997 |
| JP | 11107950 | | 4/1999 |
| JP | H11324950 | A | 11/1999 |
| JP | 2000104684 | A | 4/2000 |
| JP | 2000161263 | A | 6/2000 |
| JP | 2000329078 | A | 11/2000 |
| JP | 2003074481 | A | 3/2003 |
| JP | 2003074482 | A | 3/2003 |
| JP | 2003106258 | A | 4/2003 |
| JP | 2003227479 | A | 8/2003 |
| JP | 2007154761 | A | 6/2007 |
| JP | 2008248775 | A | 10/2008 |
| JP | 2013167215 | A | 8/2013 |
| KR | 1019870000015 | | 5/1985 |
| KR | 870000015 | B1 | 1/1987 |

(56) References Cited

FOREIGN PATENT DOCUMENTS

| | | | |
|---|---|---|---|
| KR | 20050027402 | A | 3/2005 |
| KR | 20050095246 | A | 9/2005 |
| KR | 100547323 | B1 | 1/2006 |
| KR | 20100017008 | A | 2/2010 |
| KR | 101192642 | B1 | 10/2012 |
| WO | WO-0073659 | A1 | 12/2000 |
| WO | WO-2007046810 | A2 | 4/2007 |
| WO | WO-2009017741 | A1 | 2/2009 |
| WO | WO-2009155099 | A2 | 12/2009 |
| WO | WO-2010118140 | A2 | 10/2010 |
| WO | WO-2012114455 | A1 | 8/2012 |

OTHER PUBLICATIONS

Office Action regarding Chinese Patent Application No. 201410400792.0, dated Feb. 25, 2016. Translation provided by Unitalen Attorneys at Law.
Office Action regarding Chinese Patent Application No. 201410461048.2, dated Nov. 30, 2015. Translation provided by Unitalen Attorneys at Law.
Office Action regarding U.S. Appl. No. 14/081,390, dated Mar. 27, 2015.
Office Action regarding U.S. Appl. No. 14/060,240, dated Aug. 12, 2015.
Office Action regarding U.S. Appl. No. 14/073,293, dated Jan. 29, 2016.
Office Action regarding U.S. Appl. No. 14/073,293, dated Sep. 25, 2015.
Restriction Requirement regarding U.S. Appl. No. 14/060,102, dated Mar. 16, 2016.
Restriction Requirement regarding U.S. Appl. No. 14/060,102, dated Oct. 7, 2015.
Second Office Action regarding China Application No. 201180010366.1 dated Dec. 31, 2014. Translation provided by Unitalen Attorneys At Law.
Office Action regarding U.S. Appl. No. 14/060,102, dated Jun. 14, 2016.
Office Action regarding U.S. Appl. No. 14/846,877, dated Jul. 15, 2016.
Office Action regarding U.S. Appl. No. 14/294,458, dated Aug. 19, 2016.
Office Action regarding Chinese Patent Application No. 201410460792.0, dated Oct. 21, 2016. Translation provided by Unitalen Attorneys At Law.
Search Report regarding European Patent Application No. 11747996.4, dated Nov. 7, 2016.
Office Action regarding Chinese Patent Application No. 201410461048.2, dated Jul. 26, 2016. Translation provided by Unitalen Attorneys at Law.
Search Report regarding European Patent Application No. 13858194.7, dated Aug. 3, 2016.
Search Report regarding European Patent Application No. 13859308.2, dated Aug. 3, 2016.
Advisory Action regarding U.S. Appl. No. 14/073,293, dated Apr. 18, 2016.
First Office Action regarding Chinese Application No. 201380059666.8, dated Apr. 5, 2016. Translation provided by Unitalen Attorneys at Law.
First Office Action regarding Chinese Application No. 201380062614.6, dated Apr. 5, 2016. Translation provided by Unitalen Attorneys at Law.
Office Action regarding Chinese Patent Application No. 201380059963.2, dated May 10, 2016. Translation provided by Unitalen Attorneys at Law.
Office Action regarding Chinese Patent Application No. 201380062657.4, dated May 4, 2016. Translation provided by Unitalen Attorneys at Law.
U.S. Office Action regarding U.S. Appl. No. 11/645,288 dated Nov. 30, 2009.
Extended European Search Report regarding Application No. EP07254962 dated Mar. 12, 2008.
First China Office Action regarding Application No. 200710160038.5 dated Jul. 8, 2010. Translation provided by Unitalen Attorneys At Law.
China Office Action regarding Application No. 200710160038.5 dated Jan. 31, 2012. Translation provided by Unitalen Attorneys At Law.
International Search Report regarding Application No. PCT/US2011/025921, dated Oct. 7, 2011.
Written Opinion of the International Search Authority regarding Application No. PCT/US2011/025921, dated Oct. 7, 2011.
Written regarding Application No. PCT/US2010/030248, dated Nov. 26, 2010. Opinion of the International Searching Authority.
International Search Report regarding Application No. PCT/US2010/030248, dated Nov. 26, 2010.
U.S. Office Action regarding U.S. Appl. No. 13/181,065 dated Nov. 9, 2012.
International Search Report regarding Application No. PCT/US2013/051678, dated Oct. 21, 2013.
Written Opinion of the International Searching Authority regarding Application No. PCT/US2013/051678, dated Oct. 21, 2013.
International Search Report regarding Application No. PCT/US2013/069462, dated Feb. 21, 2014.
Written Opinion of the International Searching Authority regarding Application No. PCT/US2013/069462, dated Feb. 21, 2014.
International Search Report regarding Application No. PCT/US2013/070981, dated Mar. 4, 2014.
Written Opinion of the International Searching Authority regarding Application No. PCT/US2013/070981, dated Mar. 4, 2014.
International Search Report regarding Application No. PCT/US2013/069456, dated Feb. 18, 2014.
Written Opinion of the International Searching Authority regarding Application No. PCT/US2013/069456, dated Feb. 18, 2014.
International Search Report regarding Application No. PCT/US2013/070992, dated Feb. 25, 2014.
Written Opinion of the International Searching Authority regarding Application No. PCT/US2013/070992, dated Feb. 25, 2014.
China Office Action regarding Application No. 201080020243.1 dated Nov. 5, 2013. Translation provided by Unitalen Attorneys At Law.
Search Report regarding European Patent Application No. 10762374.6-1608 / 2417356 PCT/US2010030248, dated Jun. 16, 2015.
International Search Report regarding International Application No. PCT/US2015/033960, dated Sep. 1, 2015.
Written Opinion of the International Searching Authority regarding International Application No. PCT/US2015/033960, dated Sep. 1, 2015.
Office Action regarding Chinese Patent Application No. 201410460792.0, dated Feb. 25, 2016. Translation provided by Unitalen Attorneys at Law.
U.S. Appl. No. 15/881,016, filed Jan. 26, 2018, Masao Akei et al.
Office Action regarding Chinese Patent Application No. 201380059666.8, dated Nov. 23, 2016. Translation provided by Unitalen Attorneys at Law.
Office Action regarding U.S. Appl. No. 14/060,102, dated Dec. 28, 2016.
International Search Report regarding International Application No. PCT/CN2016/103763, dated Jan. 25, 2017.
Written Opinion of the International Searching Authority regarding International Application No. PCT/CN2016/103763, dated Jan. 25, 2017.
Office Action regarding U.S. Appl. No. 15/156,400, dated Feb. 23, 2017.
Office Action regarding U.S. Appl. No. 14/294,458, dated Feb. 28, 2017.
Advisory Action regarding U.S. Appl. No. 14/060,102, dated Mar. 3, 2017.
Office Action regarding U.S. Appl. No. 14/663,073, dated Apr. 11, 2017.

(56) References Cited

OTHER PUBLICATIONS

Office Action regarding Chinese Patent Application No. 201410460792.0, dated Apr. 24, 2017. Translation provided by Unitalen Attorneys at Law.
Office Action regarding U.S. Appl. No. 14/946,824, dated May 10, 2017.
Advisory Action regarding U.S. Appl. No. 14/294,458, dated Jun. 9, 2017.
Office Action regarding Chinese Patent Application No. 201610703191.7, dated Jun. 13, 2017. Translation provided by Unitalen Attorneys at Law.
Office Action regarding Indian Patent Application No. 2043/MUMNP/2011, dated Jul. 28, 2017.
Office Action regarding U.S. Appl. No. 14/294,458, dated Sep. 21, 2017.
Office Action regarding Chinese Patent Application No. 201610158216.X, dated Oct. 30, 2017. Translation provided by Unitalen Attorneys at Law.
Office Action regarding Chinese Patent Application No. 201410460792.0, dated Nov. 1, 2017. Translation provided by Unitalen Attorneys at Law.
Office Action regarding Chinese Patent Application No. 201610512702.7, dated Dec. 20, 2017. Partial translation provided by Unitalen Attorneys at Law.
Office Action regarding Chinese Patent Application No. 201610499158.7, dated Jan. 9, 2018. Translation provided by Unitalen Attorneys at Law.
Office Action regarding Chinese Patent Application No. 201580029636.1, dated Jan. 17, 2018. Translation provided by Unitalen Attorneys at Law.
Office Action regarding U.S. Appl. No. 15/646,654, dated Feb. 9, 2018.
Office Action regarding U.S. Appl. No. 15/651,471 dated Feb. 23, 2018.
Office Action regarding Indian Patent Application No. 1907/MUMNP/2012, dated Feb. 26, 2018.
Election Requirement regarding U.S. Appl. No. 15/186,092, dated Apr. 3, 2018.
Election Requirement regarding U.S. Appl. No. 15/784,458, dated Apr. 5, 2018.
Non-Final Office Action regarding U.S. Appl. No. 15/186,151, dated May 3, 2018.

* cited by examiner

COMPRESSOR

CROSS-REFERENCE TO RELATED APPLICATIONS

This application is a continuation of U.S. patent application Ser. No. 14/060,240 filed on Oct. 22, 2013, which claims the benefit of U.S. Provisional Application No. 61/726,684, filed on Nov. 15, 2012. The entire disclosure of the above application is incorporated herein by reference.

FIELD

The present disclosure relates to a compressor.

BACKGROUND

This section provides background information related to the present disclosure and is not necessarily prior art.

Compressors are used in a variety of industrial and residential applications to circulate a working fluid within a refrigeration, heat pump, HVAC, or chiller system (generically, "climate control systems") to provide a desired heating or cooling effect. A typical climate control system may include a fluid circuit having an outdoor heat exchanger, an indoor heat exchanger, an expansion device disposed between the indoor and outdoor heat exchangers, and a compressor circulating a working fluid (e.g., refrigerant or carbon dioxide) between the indoor and outdoor heat exchangers. Efficient and reliable operation of the compressor is desirable to ensure that the climate control system in which the compressor is installed is capable of effectively and efficiently providing a cooling and/or heating effect on demand.

SUMMARY

This section provides a general summary of the disclosure, and is not a comprehensive disclosure of its full scope or all of its features.

In one form, the present disclosure provides a compressor that may include first and second scroll members and a hub assembly. The first scroll member may include a first end plate defining first and second sides opposite one another, a primary discharge passage extending through the first and second sides, a secondary discharge passage extending through the first and second sides and located radially outward from the primary discharge passage, and a first spiral wrap extending from the first side. The second scroll member may include a second end plate having a second spiral wrap extending therefrom and meshingly engaged with the first spiral wrap to form compression pockets. The hub assembly may include a hub plate and a valve. The hub plate may be mounted to the first scroll member and may include first and second sides opposite one another and having a hub discharge passage extending therethrough and in fluid communication with the primary discharge passage. The first side of said hub plate may face the second side of the first end plate and may include a valve guide extending axially toward the first spiral wrap and disposed adjacent the hub discharge passage. The valve member may be secured on the valve guide for axial movement between open and closed positions. The valve member may close the secondary discharge passage when in the closed position to restrict fluid communication between the secondary discharge passage and the hub discharge passage. The valve member may be axially spaced from the secondary discharge passage when in the open position to allow fluid communication between the secondary discharge passage and the hub discharge passage.

In some embodiments, the second side of the hub plate may include an annular central hub surrounding the hub discharge passage and an annular rim surrounding the central hub and defining an annular chamber therebetween.

In some embodiments, the first end plate may include an annular recess in the second side thereof and a first aperture located radially outward from the secondary discharge passage. The first aperture may extend through the recess and may be in communication with one of the compression pockets. The hub plate may include a second aperture extending from the annular chamber to the annular recess.

In some embodiments, the compressor may include a partition and a floating seal. The partition may separate a discharge-pressure region from a suction-pressure region of the compressor and overlying the second side of the first scroll member. The floating seal may be located in the annular chamber and may be engaged with the partition and the hub plate.

In some embodiments, the valve guide may include a radially outward extending flange at an end thereof. The valve member may be axially secured between the flange and the first side of the hub plate.

In some embodiments, the valve member may include a flat, annular disk having an opening receiving the valve guide.

In some embodiments, an inner circumferential surface of the valve member may include a pair of opposing tabs. The valve guide may include a pair of opposing gaps that receive the tabs during assembly of the valve member onto the valve guide. The tabs may be rotationally spaced from the gaps after assembly.

In some embodiments, the compressor may include a wave spring disposed between the valve member and the first side of the hub plate and biasing the valve member toward the flange to the closed position.

In some embodiments, the first side of the hub plate may include an annular recess surrounding the valve guide and receiving the wave ring therein.

In some embodiments, the second side of the first end plate may include a recess surrounding the primary discharge passage. The valve member may abut an end surface of the recess in the closed position and may be spaced apart from the end surface in the open position. The recess may define a fluid passageway extending radially through the valve guide. The secondary discharge passage may be in fluid communication with the primary discharge passage via the fluid passageway when the valve member is in the open position.

In some embodiments, the compressor may include a retaining member. The hub plate may include a flange and the first end plate may include a rim extending axially from the second side thereof beyond the flange and defining a groove extending radially into the rim. The retaining member may extend radially into the groove and may overly an axial end surface of the flange and secure the flange axially between the retaining member and the second side of the first end plate.

In some embodiments, the hub assembly may include a discharge valve assembly disposed between the hub discharge passage and a discharge chamber that receives compressed fluid from the primary discharge passage.

In another form, the present disclosure provides a compressor that may include first and second scroll members and a hub assembly. The first scroll member may include a first end plate defining first and second sides opposite one another, a primary discharge passage extending through the first and second sides, a first spiral wrap extending from the first side, an annular recess in the second side and a first aperture extending through said annular recess. The second scroll member may include a second end plate having a second spiral wrap extending therefrom and meshingly engaged with the first spiral wrap to form a series of compression pockets. The first aperture may be in communication with one of the compression pockets. The hub assembly may include a hub plate mounted to the first scroll member and may include first and second sides opposite one another and having a hub discharge passage extending therethrough and in fluid communication with the primary discharge passage. The first side of the hub plate may be adjacent the second side of the first end plate. The second side of the hub plate may include an annular hub surrounding the hub discharge passage and an annular rim surrounding the annular hub and defining an annular chamber therebetween. A second aperture may extend through the hub plate into the annular chamber and may be in communication with the annular recess.

In some embodiments, the first end plate may include a secondary discharge passage extending through the first and second sides and located radially outward from the primary discharge passage.

In some embodiments, the hub plate may include a valve guide extending axially toward the first scroll member. The primary and secondary discharge passages may be in fluid communication with the hub discharge passage through the valve guide.

In some embodiments, the compressor may include a valve member that is axially secured between a radially outwardly extending flange of the guide member and the hub plate.

In some embodiments, the valve member may include a flat, annular disk having an opening receiving the valve guide.

In some embodiments, an inner circumferential surface of the valve member may include a pair of opposing tabs. The valve guide may include a pair of opposing gaps that receive the tabs during assembly of the valve member onto the valve guide. The tabs may be rotationally spaced from the gaps after assembly.

In some embodiments, the compressor may include a wave spring disposed between the valve member and the hub plate and biasing the valve member toward the flange to a closed position in which the valve member restricts fluid flow through the secondary discharge passage.

In some embodiments, the compressor may include a retaining member. The hub plate may include a flange and the first end plate may include a rim extending axially from the second side thereof beyond the flange and defining a groove extending radially into the rim. The retaining member may extend radially into the groove and may overly an axial end surface of the flange and secure the flange axially between the retaining member and the second side of the first end plate.

In another form, the present disclosure provides a compressor that may include a compressor that may include first and second scroll members, a hub plate and a valve member. The first scroll member may include a first end plate defining first and second sides opposite one another, a primary discharge passage extending through the first and second sides, a first spiral wrap extending from the first side, an annular recess in the second side and a first aperture extending through said annular recess. The second scroll member may include a second end plate having a second spiral wrap extending therefrom and meshingly engaged with the first spiral wrap to form a series of compression pockets. The first aperture may be in communication with one of the compression pockets. The hub plate may be mounted to the first scroll member and may include first and second sides opposite one another and having a hub discharge passage extending therethrough and in fluid communication with the primary discharge passage. The first side of the hub plate may overlay the second side of the first end plate and may include a valve guide extending axially toward the first end plate and surrounding the hub discharge passage. The second side of the hub plate may include an annular hub surrounding the hub discharge passage and an annular rim surrounding the annular hub and defining an annular chamber therebetween. A second aperture may extend through the hub plate and into the annular chamber and may be in communication with the annular recess. The valve member may be secured on said valve guide for axial movement between open and closed positions. The valve member may close the secondary discharge passage when in the closed position and axially spaced from the secondary discharge passage when in the open position.

In some embodiments, the valve guide may include a radially outward extending flange at an end thereof. The valve member may be disposed between the flange and the first side of the hub plate.

In some embodiments, the valve member may include a flat, annular disk having an opening receiving the valve guide.

In some embodiments, an inner circumferential surface of the valve member may include a pair of opposing tabs. The valve guide may include a pair of opposing gaps that receive the tabs during assembly of the valve member onto the valve guide. The tabs may be rotationally spaced from the gaps after assembly.

In some embodiments, the compressor may include a wave spring disposed between the valve member and the first side of the hub plate and biasing the valve member toward the flange to the closed position.

In some embodiments, the compressor may include a retaining member. The hub plate may include a flange and the first end plate may include a rim extending axially from the second side thereof beyond the flange and defining a groove extending radially into the rim. The retaining member may extend radially into the groove and may overly an axial end surface of the flange and secure the flange axially between the retaining member and the second side of the first end plate.

In some embodiments, the compressor may include a discharge valve assembly mounted to the hub plate and disposed between the hub discharge passage and a discharge chamber that receives compressed fluid from the primary discharge passage.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
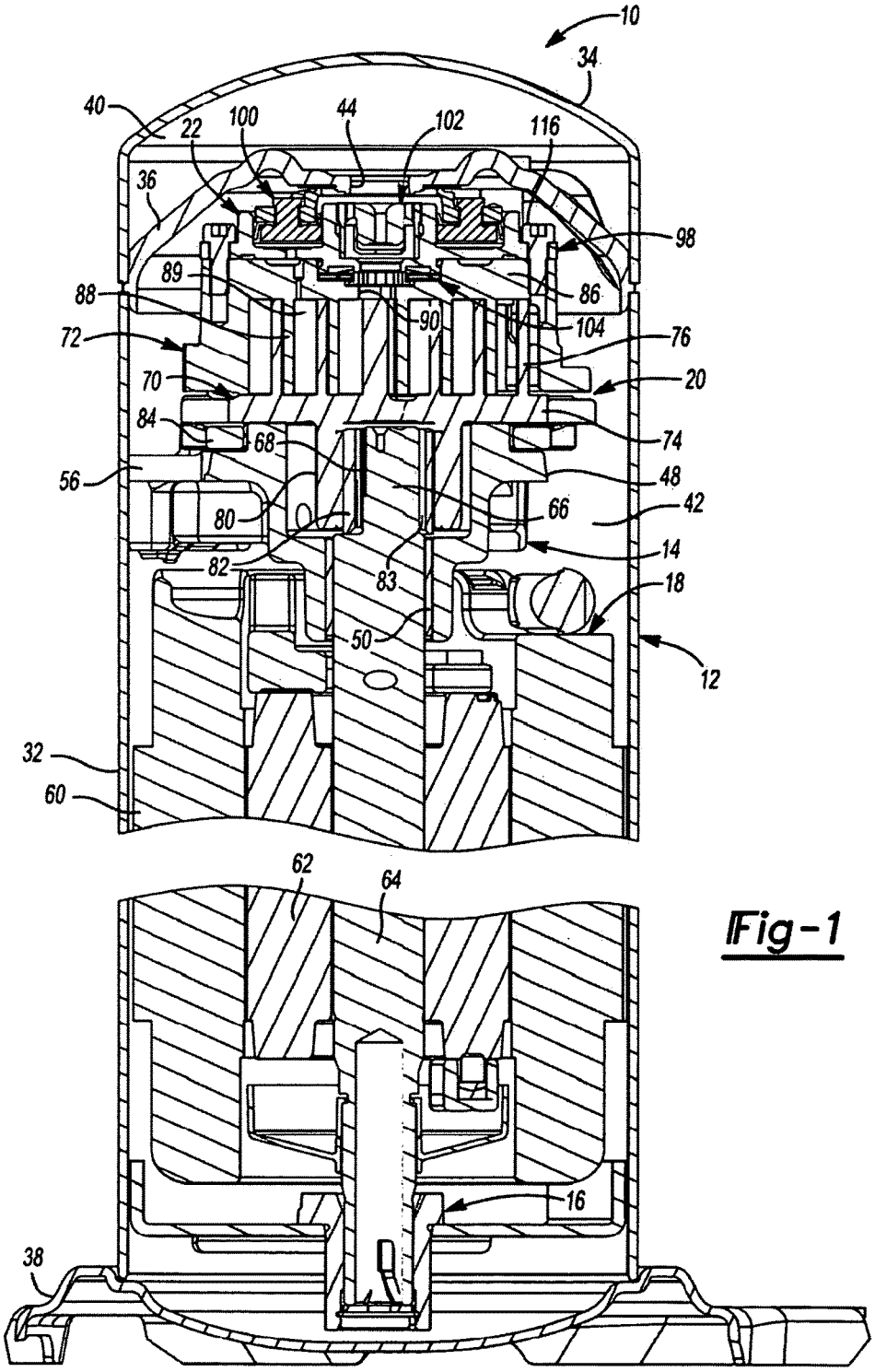
FIG. 1 is a cross-sectional view of a compressor including a hub assembly according to the principles of the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

With reference to FIGS. 1-5, a compressor 10 is provided that may include a hermetic shell assembly 12, first and second bearing-housing assemblies 14, 16, a motor assembly 18, a compression mechanism 20, and a hub assembly 22.

The shell assembly 12 may form a compressor housing and may include a cylindrical shell 32, an end cap 34 at an upper end thereof, a transversely extending partition 36, and a base 38 at a lower end thereof. The end cap 34 and the partition 36 may define a discharge chamber 40. The partition 36 may separate the discharge chamber 40 from a suction chamber 42. A discharge passage 44 may extend through the partition 36 to provide communication between the compression mechanism 20 and the discharge chamber 40. A suction fitting (not shown) may provide fluid communication between the suction chamber 42 and a low side of a system in which the compressor 10 is installed. A discharge fitting (not shown) may provide fluid communication between the discharge chamber 44 and a high side of the system in which the compressor 10 is installed.

The first bearing-housing assembly 14 may be fixed relative to the shell 32 and may include a main bearing-housing 48 and a main bearing 50. The main bearing-housing 48 may axially support the compression mechanism 20 and may house the main bearing 50 therein. The main bearing-housing 48 may include a plurality of radially extending arms 56 engaging the shell 32.

The motor assembly 18 may include a motor stator 60, a rotor 62, and a drive shaft 64. The motor stator 60 may be press fit into the shell 32. The rotor 62 may be press fit on the drive shaft 64 and may transmit rotational power to the drive shaft 64. The drive shaft 64 may be rotatably supported by the first and second bearing-housing assemblies 14, 16. The drive shaft 64 may include an eccentric crank pin 66 having a flat 68 thereon.

The compression mechanism 20 may include an orbiting scroll 70 and a non-orbiting scroll 72. The orbiting scroll 70 may include an end plate 74 and a spiral wrap 76 extending therefrom. A cylindrical hub 80 may project downwardly from the end plate 74 and may include a drive bushing 82 disposed therein. The drive bushing 82 may include an inner bore 83 in which the crank pin 66 is drivingly disposed. The crank pin flat 68 may drivingly engage a flat surface in a portion of the inner bore 83 to provide a radially compliant driving arrangement. An Oldham coupling 84 may be engaged with the orbiting and non-orbiting scrolls 70, 72 to prevent relative rotation therebetween.

The non-orbiting scroll 72 may include an end plate 86 and a spiral wrap 88 projecting downwardly from the end plate 86. The spiral wrap 88 may meshingly engage the spiral wrap 76 of the orbiting scroll 70, thereby creating a series of moving fluid pockets 89. The fluid pockets 89 defined by the spiral wraps 76, 88 may decrease in volume as they move from a radially outer position (at a suction pressure) to radially intermediate positions (at intermediate pressures) to a radially inner position (at a discharge pressure) throughout a compression cycle of the compression mechanism 20.

Figure 2:
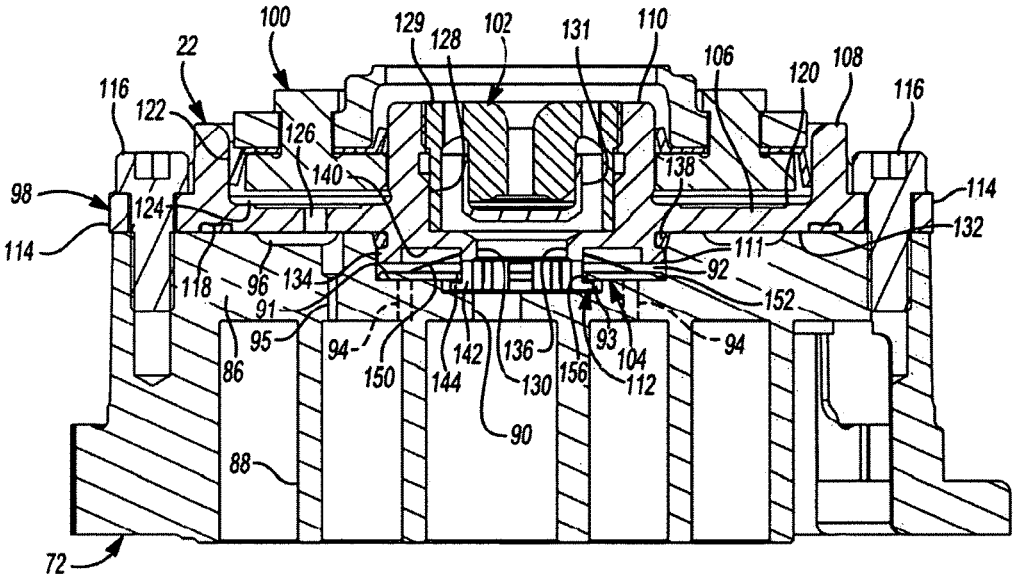
FIG. 2 is a cross-sectional view of a scroll member and the hub assembly with a valve member of the hub assembly in a first position according to the principles of the present disclosure.
Figure 3:
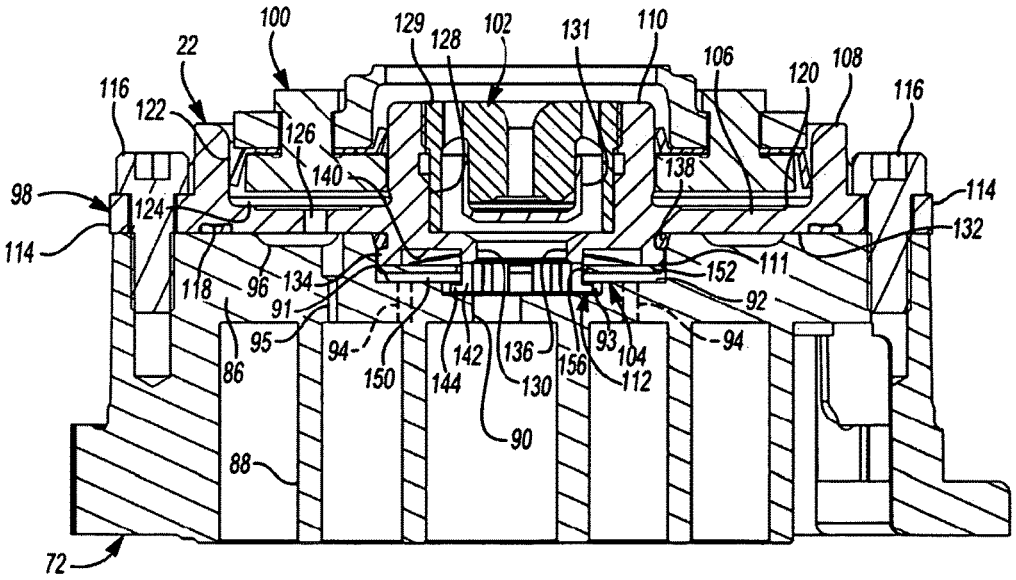
FIG. 3 is a cross-sectional view of the scroll member and hub assembly with the valve member in a second position according to the principles of the present disclosure.

As shown in FIGS. 2 and 3, the end plate 86 may include a discharge passage 90, a first discharge recess 92, a second discharge recess 93, one or more first apertures 94, a second aperture 95, and an annular recess 96. The discharge passage 90 may be in communication with one of the fluid pockets 89 at the radially inner position and allows compressed working fluid (at the discharge pressure) to flow through the hub assembly 22 and into the discharge chamber 40. The first and second discharge recesses 92, 93 may be in fluid communication with the discharge passage 90. The second discharge recess 93 may be disposed between the discharge passage 90 and the first discharge recess 92. The first apertures 94 may be disposed radially outward relative to the discharge passage 90 and may provide selective fluid communication between the fluid pockets 89 at a radially intermediate position and the first discharge recess 92. The second aperture 95 may be disposed radially outward relative to the discharge passage 90 and may be rotationally offset from the first apertures 94. The second aperture 95 may provide communication between one of the fluid pockets 89 at the radially intermediate position and the annular recess 96. The annular recess 96 may encircle the first and second discharge recesses 92, 93 and may be substantially concentric therewith.

Figure 4:
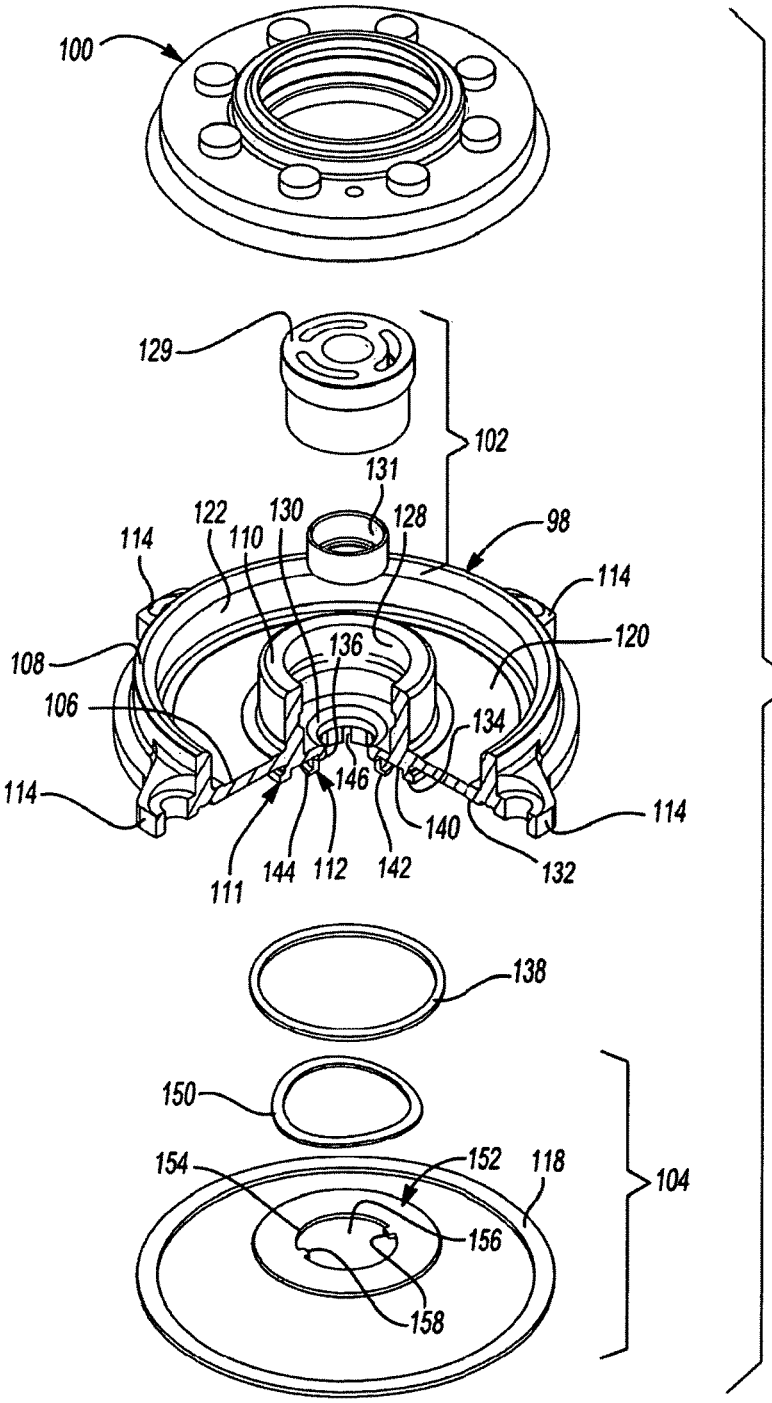
FIG. 4 is an exploded perspective view of the hub assembly according to the principles of the present disclosure.

The hub assembly 22 may be mounted to the end plate 86 of the non-orbiting scroll 72 on a side of the end plate 86 opposite the spiral wrap 88. As shown in FIGS. 2-4, the hub assembly 22 may include a hub plate 98, a seal assembly 100, a primary discharge valve assembly 102, and a secondary discharge valve assembly 104.

The hub plate 98 may include a main body 106, an annular rim 108, a first annular central hub 110, a second central annular hub 111, and a valve guide 112. Mounting flanges 114 may extend radially outward from the main body 106 and the annular rim 108 and may receive bolts 116 that secure the hub plate 98 to the end plate 86 of the non-orbiting scroll 72. A first annular gasket 118 may surround the annular recess 96 in the end plate 86 and may be disposed between and sealingly engage the main body 106 and the end plate 86.

The annular rim 108 and the first central hub 110 may extend axially upward from a first side 120 of the main body 106. The annular rim 108 may surround the first central hub 110. The annular rim 108 and the first central hub 110 may cooperate with the main body 106 to define an annular recess 122 that may movably receive the seal assembly 100 therein. As shown in FIG. 1, the seal assembly 100 may sealingly engage the partition 36. As shown in FIGS. 2 and 3, the annular recess 122 may cooperate with the seal assembly 100 to define an annular biasing chamber 124 therebetween. The biasing chamber 124 receives fluid from the fluid pocket 89 in the intermediate position through an aperture 126 in the main body 106, the annular recess 96 and the second aperture 95. A pressure differential between the intermediate-pressure fluid in the biasing chamber 124 and suction-pressure fluid in the suction chamber 42 exerts a net axial biasing force on the hub plate 98 and non-orbiting scroll 72 urging the non-orbiting scroll 72 toward the orbiting scroll 70, while still allowing axial compliance of the non-orbiting scroll 72 relative to the orbiting scroll 70 and the partition 36. In this manner, the tips of the spiral wrap 88 of the non-orbiting scroll 72 are urged into sealing engagement with the end plate 74 of the orbiting scroll 70 and the end plate 86 of the non-orbiting scroll 72 is urged into sealing engagement with the tips of the spiral wrap 76 of the orbiting scroll 70.

The first central hub 110 may define a recess 128 that may at least partially receive the primary discharge valve assembly 102. The recess 128 may include a hub discharge passage 130 in fluid communication with the discharge passage 90 in the non-orbiting scroll 72 and in selective fluid communication with the first apertures 94 in the non-orbiting scroll 72. The primary discharge valve assembly 102 may include a retainer 129 fixedly received in the recess 128 and a valve member 131 that is movably engages the retainer 129. The valve member 131 may be spaced apart from the hub discharge passage 130 (as shown in FIGS. 2 and 3) during normal operation of the compressor 10 to allow fluid to flow from the compression mechanism 20 to the discharge chamber 40. The valve member 131 may seal-off the hub discharge passage 130 after shutdown of the compressor 10 to restrict or prevent fluid from flowing from the discharge chamber 40 back into the compression mechanism 20 through the hub discharge passage 130.

The second central hub 111 may extend axially downward from a second side 132 of the main body 106 and may be substantially concentric with the first central hub 110. In some embodiments, the second central hub 111 may be eccentric relative to the first central hub 110 and/or the end plate 86 of the non-orbiting scroll 72. The second central hub 111 may be received in the first discharge recess 92 of the non-orbiting scroll 72. The second central hub 111 may include an annular outer wall 134 and an annular inner flange 136. A second annular gasket 138 may sealingly engage the outer wall 134, the second side 132 of the main body 106 and the first discharge recess 92. The outer wall 134 and inner flange 136 may cooperate to define an annular recess 140 therebetween. The inner flange 136 may cooperate with the first central hub 110 to define the hub discharge passage 130.

Figure 5:
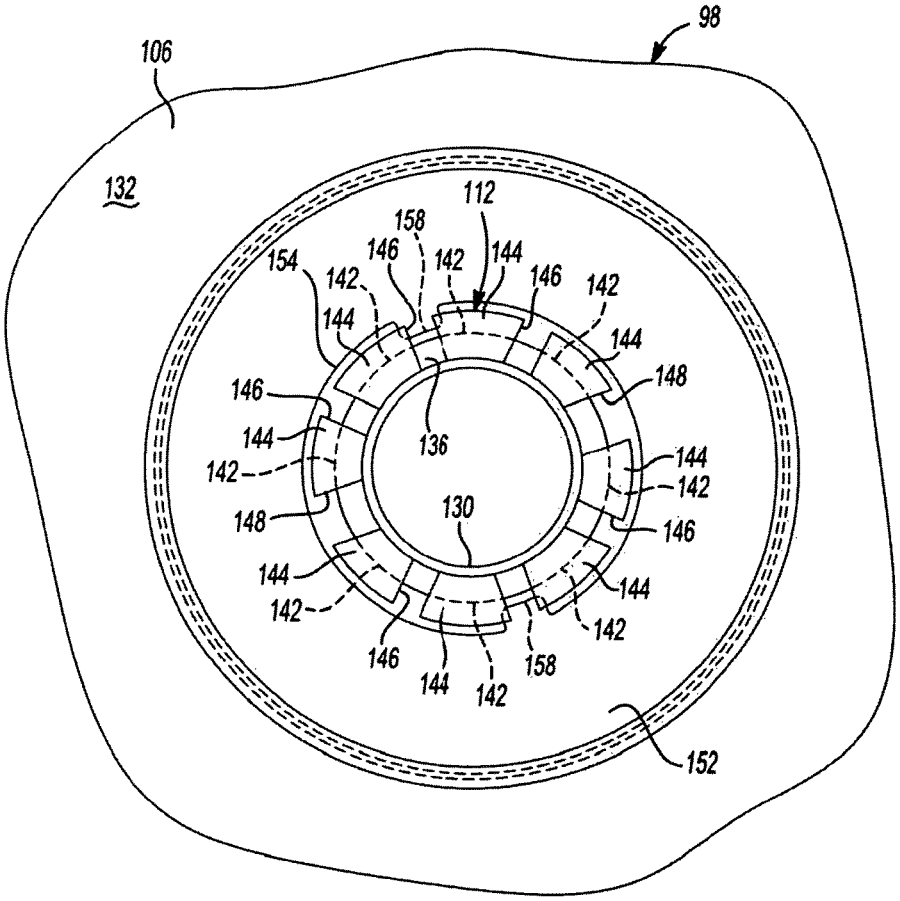
FIG. 5 is a bottom view of the hub assembly according to the principles of the present disclosure.

The valve guide 112 may extend axially downward from the second central hub 111 toward the non-orbiting scroll 72 and may surround the hub discharge passage 130. The valve guide 112 may include a plurality of legs 142 having radially outwardly extending flanges 144 at distal ends thereof. The legs 142 may extend downward from the second central hub 111 through the first discharge recess 92 and into the second discharge recess 93 such that the flanges 144 are situated in the second discharge recess 93. The legs 142 may be integrally formed with the second central hub 111 or the legs 142 could be separate components fixedly attached to the second central hub 111. Each of the legs 142 may be rotationally spaced apart from each other. As shown in FIG. 5, some of the legs 142 may be rotationally separated from each other by a first gap 146 and some of the legs 142 may be separated from each other by a second gap 148 that is larger than each of the first gaps 146. As shown in FIG. 5, one pairs of legs 142 may be separated by one second gap 148, and another pair of legs 142 may be separated by another second gap 148 that is separated from the other second gap 148 by about one-hundred-eighty degrees.

The secondary discharge valve assembly 104 may be disposed between the second central hub 111 and the non-orbiting scroll 72 and may include a resiliently compressible biasing member 150 and a valve member 152. The biasing member 150 may be at least partially received in the annular recess 140 of the second central hub 111 and may bias the valve member 152 toward an end surface 91 of the first discharge recess 92 (i.e., toward the position shown in FIG. 2). In the particular embodiment illustrated, the biasing member 150 is a wave spring that resists being flattened. It will be appreciated, however, that the biasing member 150 could be any type of spring or resiliently compressible member.

As shown in FIG. 4, the valve member 152 may be a flat, annular, disk having an inner circumferential surface 154 defining an opening 156. The inner circumferential surface 154 may also include a pair of tabs 158 that extend radially inward therefrom. The tabs 158 may be disposed about one-hundred-eighty degrees apart from each other. As shown in FIG. 5, the opening 156 includes a diameter that is larger than a diameter defined by the radially outer edges of the flanges 144. Radially inner edges of the tabs 158 may define a diameter that is less than the diameter defined by the radially outer edges of the flanges 144.

As shown in FIG. 5, the tabs 158 may include an angular width that is greater than an angular width of each of the first gaps 146, but less than an angular width of each of the second gaps 148. Therefore, the tabs 158 may fit through the second gaps 148, but may not fit through the first gaps 146. In this manner, the valve member 152 may be assembled on to the valve guide 112 by first rotationally aligning the tabs 158 with the second gaps 148. Then, the valve guide 112 may be received through the opening 156 of the valve member 152 such that the tabs 158 are received through the second gaps 148. Then, the valve member 152 may be rotated relative to the valve guide 112 so that the tabs 158 are rotationally misaligned with the second gaps 148. In this position, interference between the flanges 144 and the tabs 158 may retain the valve member 152 on the valve guide 112, while still allowing axial movement of the valve member 152 relative the valve guide 112 between a first position (FIG. 2) and a second position (FIG. 3).

As shown in FIGS. 2 and 3, the valve guide 112 may be received through the opening 156 of the valve member 152 such that the valve member 152 is disposed between the second central hub 111 and the end surface 91 of the first discharge recess 92. As described above, the valve member 152 may be movable between the first position (FIG. 2), in which the valve member 152 engages the end surface 91 of the first discharge recess 92 to restrict or prevent fluid flow through the first apertures 94, and the second position (FIG. 3), in which the valve member 152 is spaced apart from the end surface 91 to allow fluid flow through the first apertures 94. When the valve member 152 is in the second position, the first apertures 94 are allowed to fluidly communicate with the hub discharge passage 130 through the first discharge recess 92 and the gaps 146, 148 between legs 142 and flanges 144 of the valve guide 112. As described above, the biasing member 150 may bias the valve member 152 toward the first position.

It will be appreciated that the secondary discharge valve assembly 104 could be configured in any other manner to selectively allow and restrict fluid flow through the first apertures 94. For example, instead of the biasing member 150, valve member 152 and valve guide 112, a plurality of reed valves could be mounted to the hub plate 98 or the end surface 91 of the end plate 86. The reed valves may include living hinges that allow the reed valves to resiliently deflect between a closed position, in which the reed valves restrict fluid flow through the first apertures 94, and an open position, in which the reed valves allow fluid flow through the first apertures 94. Other types and/or configurations of valves could be employed to control fluid flow through the first apertures 94.

With continued reference to FIGS. 1-5, operation of the compressor 10 will be described in detail. During normal operation of the compressor 10, low-pressure fluid may be received into the compressor 10 via a suction fitting (not shown) and may be drawn into the compression mechanism 20, where the fluid is compressed in the fluid pockets 89 as they move from radially outer to radially inner positions, as described above. Fluid is discharged from the compression mechanism 20 at a relatively high discharge pressure through the discharge passage 90. Discharge-pressure fluid flows from the discharge passage 90, through the first and second discharge recesses 92, 93, through the hub discharge passage 130, through the primary discharge valve assembly 102, and into the discharge chamber 40, where the fluid then exits the compressor 10 through a discharge fitting (not shown).

Over-compression is a compressor operating condition where the internal compressor-pressure ratio of the compressor (i.e., a ratio of a pressure of the compression pocket at the radially innermost position to a pressure of the compression pocket at the radially outermost position) is higher than a pressure ratio of a system in which the compressor is installed (i.e., a ratio of a pressure at a high side of the system to a pressure of a low side of the system). In an over-compression condition, the compression mechanism is compressing fluid to a pressure higher than the pressure of fluid downstream of a discharge fitting of the compressor. Accordingly, in an over-compression condition, the compressor is performing unnecessary work, which reduces the efficiency of the compressor. The compressor 10 of the present disclosure may reduce or prevent over-compression by allowing fluid to exit the compression mechanism 20 through the first apertures 94 and the hub discharge passage 130 before the fluid pocket 89 reaches the radially inner position (i.e., a the discharge passage 90).

The valve member 152 of the secondary discharge valve assembly 104 moves between the first and second positions in response to pressure differentials between fluid in the fluid pockets 89 and fluid at the primary discharge valve assembly 102. When fluid in fluid pockets 89 at a radially intermediate position are at a pressure that is greater than the pressure of the fluid in the primary discharge valve assembly 102, the relatively high-pressure fluid in the fluid pockets 89 may flow into the first apertures 94 and may force the valve member 152 upward toward the second position (FIG. 3) to allow fluid to be discharged from the compression mechanism 20 through the first apertures 94 and into the first discharge recess 92. From the first discharge recess 92, the fluid may flow through the first and second gaps 146, 148 of the valve guide 112 and through the hub discharge passage 130 and into the discharge chamber 40. In this manner, the first apertures 94 may function as secondary discharge passages that may reduce or prevent over-compression of the working fluid.

When the pressure of the fluid in the fluid pockets 89 at the intermediate position corresponding to the first apertures 94 falls below the pressure of the fluid in the discharge chamber 40, the biasing force of the biasing member 150 may force the valve member 152 back to the first position (FIG. 2), where the valve member 152 is sealing engaged with the end surface 91 to restrict or prevent fluid-flow through the first apertures 94.

Figure 6:
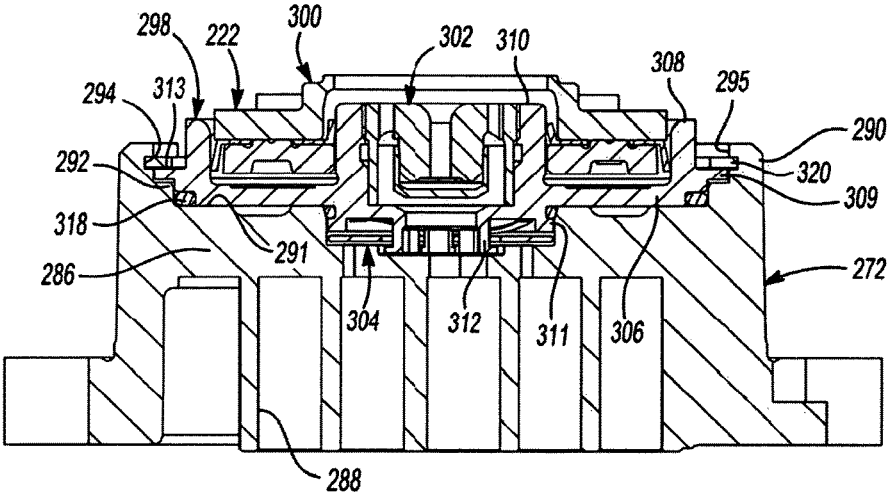
FIG. 6 is a cross-sectional view of another hub assembly and scroll member according to the principles of the present disclosure.
Figure 7:
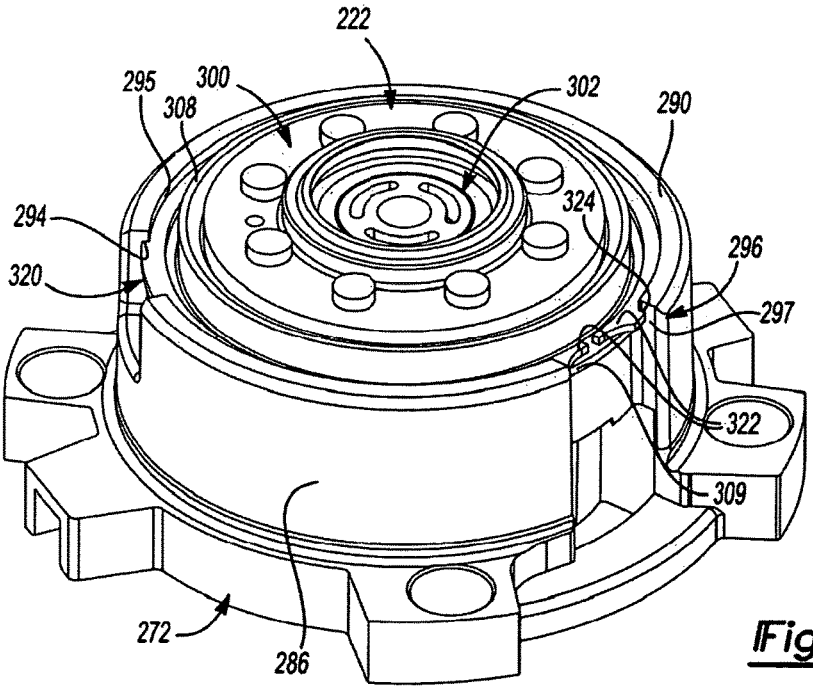
FIG. 7 is a perspective view of the hub assembly and scroll member of FIG. 6.

With reference to FIGS. 6 and 7, another non-orbiting scroll 272 and hub assembly 222 are provided. The non-orbiting scroll 272 and hub assembly 222 could be incorporated into the compressor 10 described above in place of the non-orbiting scroll 72 and hub assembly 22. The structure and function of the non-orbiting scroll 272 and hub assembly 222 may be substantially similar to that of the non-orbiting scroll 72 and hub assembly 22 described above, apart from any exceptions noted below and/or shown in the figures. Therefore, similar features will not be described again in detail.

The hub assembly 222 may include a hub plate 298, a seal assembly 300, a primary discharge valve assembly 302, and a secondary discharge valve assembly 304. The structures and functions of the seal assembly 300 and the primary and secondary discharge valve assemblies 302, 304 may be substantially identical to that of the seal assembly 100 and the primary and secondary discharge valve assemblies 102, 104, respectively.

The structure and function of the hub plate 298 may be substantially similar to that of the hub plate 98 described above. Like the hub plate 98, the hub plate 298 may include a main body 306, an annular rim 308, first and second central hubs 310, 311, and a valve guide 312. The hub plate 298 may also include an annular flange 309 extending radially outward from the annular rim 308.

Like the non-orbiting scroll 72, the non-orbiting scroll 272 may include an end plate 286 and a spiral wrap 288 projecting downwardly from the end plate 286. The end plate 286 and spiral wrap 288 may be substantially similar to the end plate 86 and spiral wrap 88 described above, except the end plate 286 may include an annular rim 290. The annular rim 290 may extend axially upward from a periphery of a surface 291 of the end plate 286 that is opposite the spiral wrap 288. The annular rim 290 and the surface 291 may cooperate to define a recess that at least partially receives the hub assembly 222. An annular step 292 may extend radially inward from the annular rim 290. The annular flange 309 of the hub plate 298 may be disposed axially above the annular step 292 when the hub assembly 222 is mounted to the non-orbiting scroll 272. An annular gasket 318 may sealingly engage the hub plate 298 and the annular step 292. An annular groove 294 may be formed in an inner circumferential surface 295 of the annular rim 290 above the annular step 292. As shown in FIG. 7, a cutout 296 may be formed in a periphery of the end plate 286.

An annular retaining member 320 may extend radially into the annular groove 294 and may overlay an axial end surface 313 of the annular flange 309 of the hub plate 298. In this manner, the retaining member 320 may secure the annular flange 309 axially between the retaining member 320 and the surface 291 of the end plate 286.

The retaining member 320 may be a resiliently flexible ring having barbed ends 322 (FIG. 7) that face each other and are spaced apart from each other. Steps 324 formed in the ends 322 may engage corresponding surfaces 297 that define the cutout 296.

To install the retaining member 320 onto the non-orbiting scroll 272, the retaining member 320 may be compressed until its diameter is less than the inner diameter of the rim 290. Then, the retaining member 320 can be aligned with the annular groove 294. Once aligned with the annular groove 294, the retaining member 320 can be allowed to expand so that the retaining member 320 can be received into the annular groove 294. Once received in the annular groove 294, the retaining member 320 may axially secure the hub plate 298 relative to the end plate 286.

It will be appreciated that the additional or alternative retaining devices, fasteners and/or attachment means could be employed to attach the hub assembly 22, 222 to the non-orbiting scroll 72, 272.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A compressor comprising:

a first scroll member including a first end plate defining first and second sides opposite one another, a primary discharge passage extending through said first and second sides, a secondary discharge passage extending through said first and second sides and located radially outward from said primary discharge passage, a first spiral wrap extending from said first side;

a second scroll member including a second end plate having a second spiral wrap extending therefrom and meshingly engaged with said first spiral wrap to form a series of compression pockets;

a driveshaft including an eccentric portion coupled with said second scroll member;

a hub plate mounted to said first scroll member and including a hub discharge passage extending therethrough and in fluid communication with said primary discharge passage, a first side of said hub plate overlying said second side of said first end plate of said first scroll member and including a valve guide extending axially toward said first end plate of said first scroll member, a second side of said hub plate including an annular hub surrounding said hub discharge passage and an annular rim surrounding said annular hub and defining an annular chamber therebetween, said hub plate including an aperture opening into said annular chamber; and a valve member disposed radially outward relative to said valve guide and movable between open and closed positions, said valve member closing said secondary discharge passage when in the closed position and opening said secondary discharge passage when in the open position.

2. The compressor of claim 1, further comprising a partition separating a discharge-pressure region from a suction-pressure region of the compressor, and a floating seal located in said annular chamber and engaged with said partition and said hub plate.

3. The compressor of claim 1, wherein said first end plate of said first scroll member includes an aperture located radially outward from said secondary discharge passage and in communication with one of said compression pockets, said aperture in said first end plate of said first scroll member is in communication with said aperture in said hub plate.

4. The compressor of claim 1, wherein said annular chamber is an axial biasing chamber that contains intermediate-pressure working fluid during operation of the compressor that biases said first scroll member axially toward said second scroll member.

5. The compressor of claim 1, wherein said annular central hub surrounds a plurality of curved slots.

6. The compressor of claim 1, further comprising a plurality of threaded fasteners extending through said hub plate and threadably engaging said first end plate of said first scroll member to secure said hub plate to said first end plate of said first scroll member.

7. The compressor of claim 1, further comprising a primary discharge valve movable between open and closed positions to allow and restrict fluid flow through said hub discharge passage.

8. The compressor of claim 1, wherein said secondary discharge passage is in fluid communication with said primary discharge passage when said valve member is in the open position.

9. A compressor comprising:

a shell;

a first scroll member disposed within said shell and including a first end plate defining first and second sides opposite one another, a primary discharge passage extending through said first and second sides, a secondary discharge passage extending through said first and second sides and located radially outward from said primary discharge passage, and a first spiral wrap extending from said first side;

a second scroll member including a second end plate having a second spiral wrap extending therefrom and meshingly engaged with said first spiral wrap to form compression pockets; and a hub plate mounted to said first scroll member having a hub discharge passage extending therethrough and in fluid communication with said primary discharge passage, said hub plate including a valve guide disposed adjacent said hub discharge passage and extending axially toward said first spiral wrap; and a valve member disposed radially outward relative to said valve guide and movable relative to said valve guide between open and closed positions, said valve member restricting fluid flow through said secondary discharge passage when in the closed position to restrict fluid communication between said secondary discharge passage and said hub discharge passage and allowing fluid flow through from said secondary discharge passage when in the open position to allow fluid communication between said secondary discharge passage and said hub discharge passage;

wherein said hub plate includes an annular central hub surrounding said hub discharge passage and an annular rim surrounding said annular central hub and defining an annular chamber therebetween.

10. The compressor of claim 9, further comprising a partition separating a discharge-pressure region from a suction-pressure region of the compressor, and a floating seal located in said annular chamber and engaged with said partition and said hub plate.

11. The compressor of claim 10, wherein said first end plate includes a first aperture located radially outward from said secondary discharge passage and in communication with one of said compression pockets, said hub plate including a second aperture in communication with said first aperture and said annular chamber.

12. The compressor of claim 11, wherein said annular chamber is an axial biasing chamber that contains intermediate-pressure working fluid during operation of the compressor that biases said first scroll member axially toward said second scroll member.

13. The compressor of claim 9, wherein said annular central hub surrounds a plurality of curved slots.

14. The compressor of claim 9, wherein the first scroll member is a non-orbiting scroll member.

15. The compressor of claim 9, further comprising a plurality of threaded fasteners extending through said hub plate and threadably engaging said first end plate to secure said hub plate to said first end plate.

16. The compressor of claim 9, further comprising a primary discharge valve movable between open and closed positions to allow and restrict fluid flow through said hub discharge passage.

17. The compressor of claim 9, wherein said secondary discharge passage is in fluid communication with said primary discharge passage when said valve member is in the open position.

18. A compressor comprising:

a shell;

a first scroll member disposed within said shell and including a first end plate defining first and second sides opposite one another, a primary discharge passage extending through said first and second sides, a secondary discharge passage extending through said first and second sides and located radially outward from said primary discharge passage, and a first spiral wrap extending from said first side;

a second scroll member including a second end plate having a second spiral wrap extending therefrom and meshingly engaged with said first spiral wrap to form compression pockets; and a hub plate mounted to said first scroll member and including first and second sides opposite one another and having a hub discharge passage extending therethrough and in fluid communication with said primary discharge passage, said first side of said hub plate facing said second side of said first end plate and including a valve guide disposed adjacent said hub discharge passage and extending axially toward said first spiral wrap; and a valve member retained by said valve guide for axial movement between open and closed positions, said valve member closing said secondary discharge passage when in the closed position to restrict fluid communication between said secondary discharge passage and said hub discharge passage and axially spaced from said secondary discharge passage when in the open position to allow fluid communication between said secondary discharge passage and said hub discharge passage;

wherein said second side of said hub plate includes an annular central hub surrounding said hub discharge passage and an annular rim surrounding said annular central hub and defining an annular chamber therebetween, wherein said second side of said first end plate includes a recess surrounding said primary discharge passage, said valve member abutting an end surface of said recess in the closed position and spaced apart from the end surface of said recess in the open position, said recess defining a fluid passageway extending radially through said valve guide, said secondary discharge passage being in fluid communication with said primary discharge passage via said fluid passageway when said valve member is in the open position.

* * * * *